US006550271B2

(12) United States Patent
Silbert

(10) Patent No.: US 6,550,271 B2
(45) Date of Patent: Apr. 22, 2003

(54) NEOPRENE BOTTLE INSULATOR

(76) Inventor: Curt Edward Silbert, 2650 Tall Wind Ct., Crofton, MD (US) 21114

( * ) Notice: Subject to any disclaimer, the term of this patent is extended or adjusted under 35 U.S.C. 154(b) by 0 days.

(21) Appl. No.: 09/797,478

(22) Filed: Mar. 1, 2001

(65) Prior Publication Data

US 2001/0032867 A1 Oct. 25, 2001

Related U.S. Application Data

(60) Provisional application No. 60/186,278, filed on Mar. 1, 2000.

(51) Int. Cl.[7] ..... F25D 3/08
(52) U.S. Cl. ..... 62/457.4; 62/457.3; 62/371
(58) Field of Search ..... 62/457.3, 457.4, 62/371

(56) References Cited

U.S. PATENT DOCUMENTS 4,197,890 A * 4/1980 Simko ..... 150/2.2
4,955,516 A * 9/1990 Satterfield ..... 224/35
5,555,746 A * 9/1996 Thompson ..... 62/457.4
5,582,028 A * 12/1996 Rilling et al. ..... 62/530

* cited by examiner

*Primary Examiner*—William C. Doerrler
*Assistant Examiner*—Mark Shulman
(74) *Attorney, Agent, or Firm*—Andrew Jiranek; Jiranek, Goldman & Minton, P.C.

(57) ABSTRACT

A decorative thermally insulated beverage bottle holder having a detachable carrying strap, a bottle opener, and a bottle cap. The bottle holder is made of a flexible insulating material such as neoprene. A vertically disposed zipper allows for the easy opening and closing of the contour fitting holder. Indicia can be placed on the holder to enhance its appearance.

9 Claims, 2 Drawing Sheets

NEOPRENE BOTTLE INSULATOR

This application claims benefit of Prov. No. 60/186,278 filed Mar. 1, 2000.

BACKGROUND OF THE INVENTION

1. Field of the Invention

The present invention relates generally to beverage bottle holders and more particularly, to an insulated beverage bottle jacket adapted for carrying beverage bottles. The insulated jacket is made of neoprene.

2. Description of Related Art

Having a cold beverage readily available and at the same time having one's hands free from holding the beverage creates an awkward dilemma. Frequently, people like to enjoy a cold beverage while having their hands free for other activities. However, whether in a social setting such a bar or attending a sporting event such as a football game, enjoying a cold beverage requires a person to continuously hold the beverage with at least one hand. This preoccupation with one's beverage diminishes the enjoyment of the activity.

The prior art describes a variety of bottle holders, for example, an ornamental design for a bottle jacket is described in U.S. Pat. No. Des. 334,889, issued on Apr. 20, 1993 to K. Condemi et al. U.S. Pat. No. 4,197,890, issued on Apr. 15, 1980 to J. F. Simko, describes an insulating jacket for bottles. The insulation jacket consists of a cylindrical wrapper of thin flexible insulating material and has top and bottom closures.

An insulated bottle holder is described in U.S. Pat. No. 4,708,254, issued on Nov. 24, 1987 to J. E. Byrns. The insulated bottle holder consists of an outer shell made of a moldable, resilient plastic material and inner removable insulating liner. U.S. Pat. No. 5,261,554, issued on Nov. 16, 1993 to D. G. Forbes, describes an insulated beverage container. The insulated beverage container is characterized by an insulated tube of selected length provided with circular end collars having removable, sealing lids and a flexible connecting strap for maintaining at least one of the lids in a closed condition on one end of the insulated tube.

None of the above inventions and patents, taken either singly or in combination, is seen to describe the instant invention as claimed.

SUMMARY OF THE INVENTION

Accordingly, it is a principal object of the invention to provide a thermally insulated beverage bottle holder.

It is another object of the invention to provide a beverage bottle holder that conforms to the shape of the bottle.

It is a further object of the invention to provide a beverage bottle holder that allows hands-free activity.

Still another object of the invention is to provide a beverage bottle holder that has an auxiliary bottle cap and bottle opener.

It is an object of the invention to provide improved elements and arrangements thereof in an insulated beverage bottle holder for the purposes described which is inexpensive, dependable and fully effective in accomplishing its intended purposes.

To meet the above objectives, the present invention provides a decorative neoprene beverage bottle jacket that has a convenient detachable carrying strap. In a first embodiment, the thermally insulated beverage bottle jacket of the present invention has an ancillary bottle cap and bottle opener. Therefore, the bottle opener of the beverage bottle holder of the present invention can be used to remove the cap from a bottle such as a beer bottle and the bottle cap of the beverage bottle holder can be used to keep the contents of the beverage bottle fresh. The detachable strap can be straddled around a person's neck or draped over a person's shoulder for hands free holding and carrying of a beverage bottle. The insulated beverage bottle jacket has a conveniently located zipper that allows for easy insertion or removal of a beverage bottle. Indicia can be placed on the jacket to enhance its appearance or to communicate some message.

In a second embodiment, the thermally insulated beverage bottle jacket has a convenient pocket for storing items and a thermo-coolant lining containing a refrigerant that can be frozen. The frozen thermo-coolant lining serves to maintain a cold condition.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
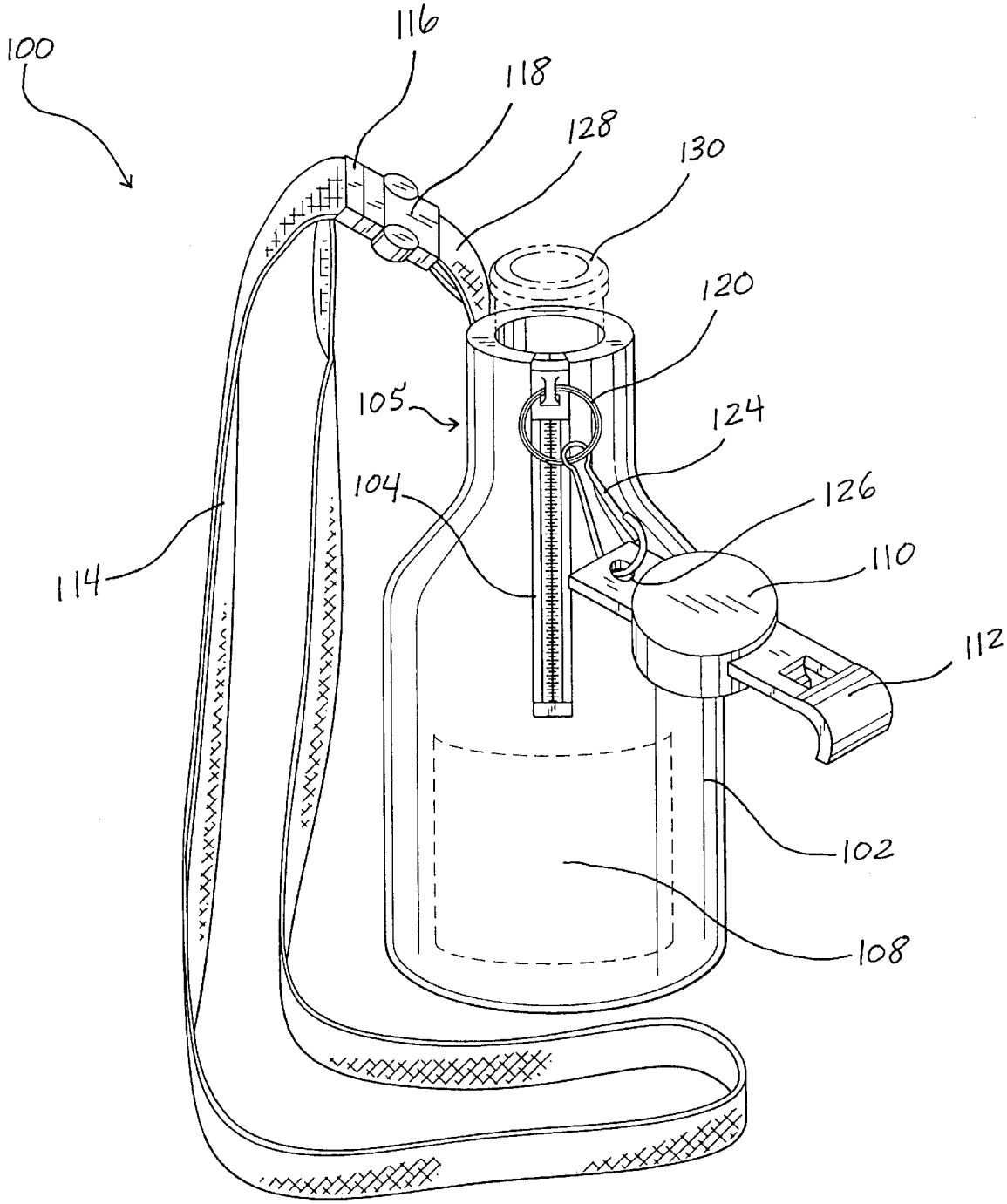
FIG. 1 is an environmental, perspective view of a neoprene beverage bottle jacket as viewed from the front according to the present invention.
Figure 2:
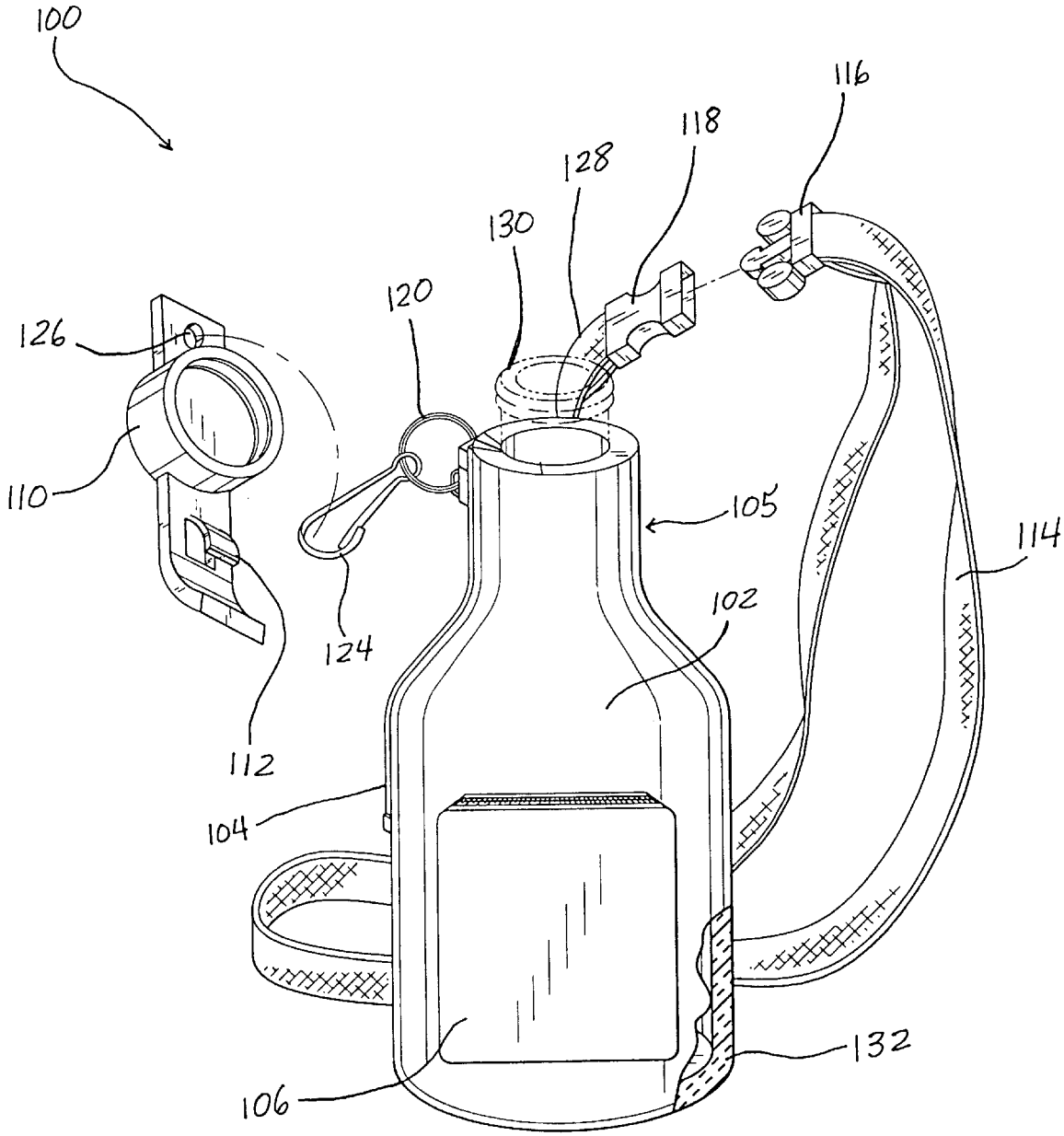
FIG. 2 is a partially exploded, environmental, perspective view of a second embodiment of a neoprene beverage bottle jacket as viewed from the side with the jacket broken away and partly in section.

The present invention as depicted in FIGS. 1 and 2 is a thermally insulated beverage bottle jacket 100 for holding and maintaining the temperature of a bottled beverage 130. FIG. 1 is an environmental, perspective view of a first embodiment of a beverage bottle jacket 100 as viewed from the front. The beverage bottle jacket 100 is made of a flexible insulating material 102 such as neoprene, however, any suitable flexible insulating material 102 may be used. The beverage bottle jacket 100 has a tapered neck 105 as shown in FIGS. 1 and 2. The bottle contour fitting or conforming shape of the jacket 100 ensures a snug fit which enhances the insulating capability of the jacket 100 by eliminating thermally conductive gaps between the beverage bottle 130 and the jacket 100. Indicia (not shown) can be placed on the jacket 100 to enhance the physical appearance of the jacket 100 or to display information such as a logo. The area 108 below the zipper 104 is one possible location for indicia, however, any portion of the jacket 100 could bear indicia.

The bottle holder or jacket 100 of the present invention has many novel and unique features such as a detachable carrying strap 114 and a detachable one piece combination bottle opener 112 and bottle cap 110. The detachable carrying strap 114 allows for easy holding and transport of a beverage bottle in the jacket 100. The carrying strap 114 can be straddled around a person's neck or draped over a person's shoulder for hands free holding and carrying of a beverage bottle 130. Because the carrying strap 114 is detachable as shown in FIG. 2, straps of different colors, designs, and styles can be used.

A vertically disposed zipper 104 having a ring 120 allows for the easy opening and closing of the beverage bottle jacket 100. Therefore, a cold beverage bottle is readily inserted into or removed from the beverage bottle jacket 100. The bottle opener 112 of the beverage bottle jacket 100 is used to remove the cap (not shown) from a bottle 130, such as a beer bottle, and the bottle cap 110 of the beverage bottle jacket 100 is used to keep the contents of the beverage bottle fresh once the original beverage bottle cap (not shown) is removed.

FIG. 2 is an environmental, perspective view of a second embodiment of a beverage bottle jacket 100 as viewed from the side. In this embodiment, the beverage bottle jacket 100 has a convenient laterally disposed pocket 106 for storing items such as keys or money and a thermo-coolant lining 132 containing a refrigerant that can be frozen. The pocket 106 can be located in any suitable location on the beverage bottle jacket 100. The frozen thermo-coolant lining 132 serves to maintain a cold condition thereby ensuring that a cold beverage bottle stays cold for a long period of time.

The detachable carrying strap 114 is attached to the beverage bottle jacket 100 by means of a clip mechanism 116, 118 wherein one Portion 118 of the clipping mechanism 116, 118 is attached to a strap 128 integrally formed with the jacket 100 as shown in FIG. 2, however, any suitable attachment means could be used to attach the carrying strap 114 to the beverage bottle jacket 100. The one piece combination bottle opener 112 and bottle cap 110 has an opening 126 that is used to removably attach the combination bottle opener 112 and bottle cap 110 to the beverage bottle jacket 100 using the ring 120 of the zipper 104 and a clip 124 as depicted in FIG. 1, however, any suitable attachment means or arrangement could be used. The detachable carrying strap 114 and the one-piece combination bottle opener 112 and bottle cap 110 can be attached at separate locations on the beverage bottle jacket 100 as depicted in FIG. 1 or at a single location on the beverage bottle jacket (not shown). The carrying strap 114 can be made of any strong, durable material that provides the carrying strap 114 with sufficient strength to readily support the weight of a beverage filled bottle 130, for example, the carrying strap 114 could be made of neoprene, The thermally insulated beverage bottle holder of the present invention provides the consumer with a variety of amenities in a single package. The consumer can enjoy a cold beverage while participating in activities that require a free pair of hands. Not only does the beverage bottle holder of the present invention keep a beverage bottle cold but it also keeps the contents of the beverage bottle fresh. Furthermore, the beverage bottle holder of the present invention allows for the easy and convenient storage of personal items while participating in hands free activities.

The preferred embodiments of the present invention disclosed herein are intended to be illustrative only and are not intended to limit the scope of the invention. It should be understood by those skilled in the art that various modifications and adaptations of the present invention as well as alternative embodiments of the present invention may be contemplated.

It is to be understood that the present invention is not limited to the sole embodiments described above, but encompasses any and all embodiments within the scope of the following claims.

I claim:

1. A beverage bottle jacket for a beverage bottle having a tapered neck, comprising:

flexible insulating material contoured to surround and conform to the shape of said beverage bottle and said tapered neck;

vertically disposed zipper applied to said flexible insulating material opening said flexible insulating material to admit said beverage bottle;

carrying strap having sufficient length to be worn around the neck of a consumer and having sufficient strength to support the weight of a full beverage bottle, wherein said carrying strap is detachably engaged to said flexible insulating material; and combination bottle opener and bottle cap detachably engaged to said flexible insulating material, comprising a bottle opener means for removing a bottle cap disposed upon a first end portion of said combination bottle opener and bottle cap, and bottle cap means for removably sealing an open beverage bottle disposed upon a center portion of said combination bottle opener and bottle cap.

2. The beverage bottle jacket of claim 1 wherein said carrying strap is detachably engaged to said flexible insulating material by means of a detachable clipping mechanism having first portion of said clipping mechanism securely attached to said carrying strap and having second portion securely attached to said flexible insulating material.

3. The beverage bottle jacket of claim 1 wherein said combination bottle opener and bottle cap is attached to said flexible insulating material by means of a detachable clipping mechanism securely attached to a second end portion of said combination bottle opener and bottle cap and detachably engaged to a ring disposed on said zipper.

4. The beverage bottle jacket of claim 1 wherein said flexible insulating material comprises neoprene.

5. The beverage bottle jacket of claim 1 wherein said carrying strap comprises a length of neoprene.

6. The beverage bottle jacket of claim 1 further comprising a pocket disposed upon said flexible insulating material.

7. The beverage bottle jacket of claim 1 further comprising an indicia disposed upon said flexible insulating material.

8. The beverage bottle jacket of claim 1 further comprising a thermo-coolant lining disposed within said flexible insulating material and adjacent to said beverage bottle.

9. A beverage bottle jacket for a beverage bottle having a tapered neck, comprising:

flexible insulating material comprising neoprene and contoured to surround and conform to the shape of said beverage bottle and said tapered neck;

vertically disposed zipper applied to said flexible insulating material opening said flexible insulating material to admit said beverage bottle;

carrying strap comprising a length of neoprene having sufficient length to be worn around the neck of a consumer and having sufficient strength to support the weight of a full beverage bottle, wherein said carrying strap is detachably engaged to said flexible insulating material, and wherein said carrying strap is detachably engaged to said flexible insulating material by means of a detachable clipping mechanism having first portion of said clipping mechanism securely attached to said carrying strap and having second portion securely attached to said flexible thermally insulating material, and combination bottle opener and bottle cap detachably engaged to said flexible thermally insulating material, comprising a bottle opener means for removing a bottle cap disposed upon a first end portion of said combination bottle opener and bottle cap, and bottle cap means for removably scaling an open beverage bottle disposed upon a center portion of said combination bottle opener and bottle cap, wherein said combination bottle opener and bottle cap is attached to said insulating material by means of a detachable clipping mechanism securely attached to a second end portion of said combination bottle opener and bottle cap and detachably engaged to a ring disposed on said zipper.

* * * * *